US005864201A

United States Patent [19]

Gehring et al.

[11] Patent Number: 5,864,201

[45] Date of Patent: Jan. 26, 1999

[54] ELECTRON-OPTICAL DEVICE HAVING SEPARATE ELONGATE ELECTRON-EMITTING REGIONS

[75] Inventors: Frederik C. Gehring; Tom Van Zutphen; Albert Manenschijn, all of Eindhoven, Netherlands

[73] Assignee: U.S. Philips Corporation, New York, N.Y.

[21] Appl. No.: 709,403

[22] Filed: Sep. 4, 1996

[30] Foreign Application Priority Data

Sep. 4, 1995 [EP] European Pat. Off. ..... 95202372

[51] Int. Cl.[6] ..... H01J 29/50

[52] U.S. Cl. ..... 313/412; 313/414; 313/310; 313/338

[58] Field of Search ..... 313/412, 414, 313/310, 338, 339, 309, 336, 351, 618, 495

[56] References Cited

U.S. PATENT DOCUMENTS 4,091,311 5/1978 Mendelsohn et al. ..... 313/455
4,749,904 6/1988 Vasterink et al. ..... 313/424

*Primary Examiner*—Vip Patel
*Attorney, Agent, or Firm*—Robert J. Kraus

[57] ABSTRACT

Electron-optical device having two elongate emitting regions arranged symmetrically with respect to a longitudinal axis for producing two electron beams having an elongate cross-section. By means of electron grids, the two beams are focused at the same point of an electron target arranged transversely to the longitudinal axis and having a short central axis and a long central axis. The elongate emitting regions have their smallest cross-section parallel to the scanning direction of a device, cooperating with the electron-optical device, for scanning a target arranged transversely to the longitudinal axis.

9 Claims, 4 Drawing Sheets

ELECTRON-OPTICAL DEVICE HAVING SEPARATE ELONGATE ELECTRON-EMITTING REGIONS

BACKGROUND OF THE INVENTION

The invention relates to an electron-optical device having a longitudinal axis, an electron-emitting region located in a first plane transverse to the axis, and an electron target located opposite thereto in a second plane transverse to the axis, said target having first and second orthogonal axes, the device further comprising a plurality of electron grids arranged between the first and second plane along the longitudinal axis, each grid having at least one aperture for passing electrons.

A device of this type is known, for example, from U.S. Pat. No. 4,749,904 (=PHN 11.615). In display tubes the electron target is formed by the phosphor screen. To produce a picture usually the electron beam scans the phosphor screen line by line along lines parallel to the longer axis of the screen (the x-axis), the screen having an y-axis orthogonal to the x-axis).

The known device has an electron emitter of the semiconductor type (referred to as cold cathode) with an annular electron-emitting region, but the invention is not limited to this type of electron emitter and is also suitable for use in directly or indirectly heated thermionic cathodes.

An increasingly important aspect in the use of present-day (display tubes comprising) electron-optical devices is that it should be possible to maintain a uniform spot size upon deflection of the electron beam across the entire electron target (=phosphor screen in a display tube). This is a particularly important aspect in (color) monitor tubes.

SUMMARY OF THE INVENTION

The invention provides a solution for more readily complying with this requirement.

To this end, an electron-optical device of the type described in the opening paragraph is characterized in that the electron-emitting region comprises two elongate (linear or curved) sub-regions extending on either side of the longitudinal axis, which sub-regions have their smallest transverse dimension substantially parallel to one of the axes of the target.

In the central area of the emitting region between these sub-regions there is no emission.

By using two linear (elongate) emitting regions arranged on either side of (and in many cases symmetrically with respect to) the longitudinal axis, the device according to the invention produces two sub-beams having an elongate cross-section. By orienting the short axis of each emitting sub-region parallel to the scanning direction (generally, this is the long phosphor screen axis (the x-axis)) and by focusing the subbeams at the same position on the phosphor screen by means of an electron-optical focusing lens, the possibility is created to achieve a uniform spot throughout the display screen, both in the x-direction and in the y-direction (by means of dynamic focusing). Dynamic underfocusing in the x-direction yields an adjustable spot size in the x-direction.

The invention provides a number of different embodiments for realizing sub-regions arranged symmetrically with respect to a longitudinal axis and generating (symmetrical) sub-beams (parts, or shells, of a hollow beam).

In accordance with a first embodiment, the emitting region itself may comprise two sub-regions which are defined either by annular segments or by line segments.

In accordance with a second embodiment, the two sub-regions are defined by apertures provided in a grid (said apertures being off-set with respect to the longitudinal axis), below which grid a thermionic-cathode surface is situated.

In accordance with a third embodiment, the annular segments, or the apertures in the form of annular segments, span an angle (have an aperture angle) of between 1° and 160° so as to obtain an effective operation. The size of the aperture angle chosen in this region is a compromise between the quantity of current to be supplied and the desired electron-optical quality. A value of between 1° and 90°, particularly between 20° and 60°, is favorable in, for example, an electron-optical respect.

It is to be noted that overfocusing in the y-direction upon deflecting the beam across the screen gives rise to haze in conventional display tubes with self-convergent deflection units. In the device according to the invention, there is spot widening upon overfocusing in the y-direction, but no haze. Dynamic underfocusing in the y-direction yields an adjustable y-spot size.

These and other aspects of the invention will be apparent from and elucidated with reference to the embodiments described hereinafter.

DESCRIPTION OF THE PREFERRED EMBODIMENT

Figure 1:
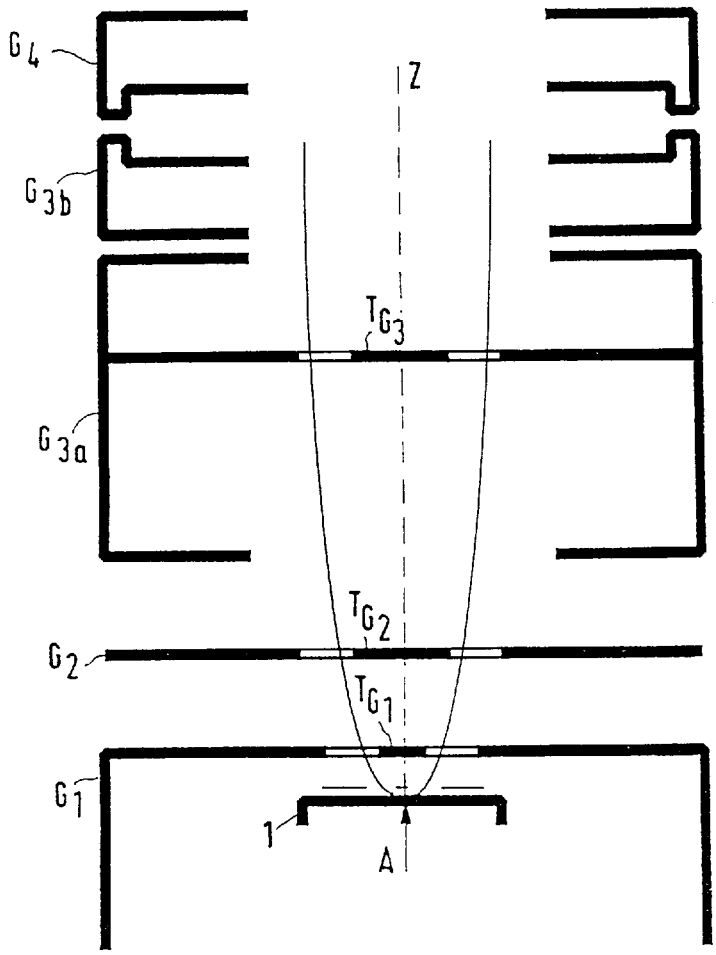
FIG. 1 is a diagrammatic cross-section through a part of an electron-optical device which forms part of a vacuum tube (not shown) having an electron target showing two electron paths.

FIG. 1 is a cross-section of a part of an electron-optical device.

This device has a longitudinal axis Z along which a plurality of electron grids $G_1$, $G_2$, $G_{3a}$, $G_{3b}$ and $G_4$ are arranged. An electron-emitting region A is present proximate to the point of intersection of the longitudinal axis and an emitter support 1. In this case, this is a surface of a semiconductor cathode provided with a planar optical system. If the correct voltages with respect to the electron-emitting region are applied to the planar optical system and to the grids $G_1$, $G_2$, $G_3$,, $G_{3b}$, emitted electrons will follow the electron paths shown diagrammatically in FIG. 1. In this embodiment, these paths initially move away from the longitudinal axis Z and then bend back.

Figure 2:
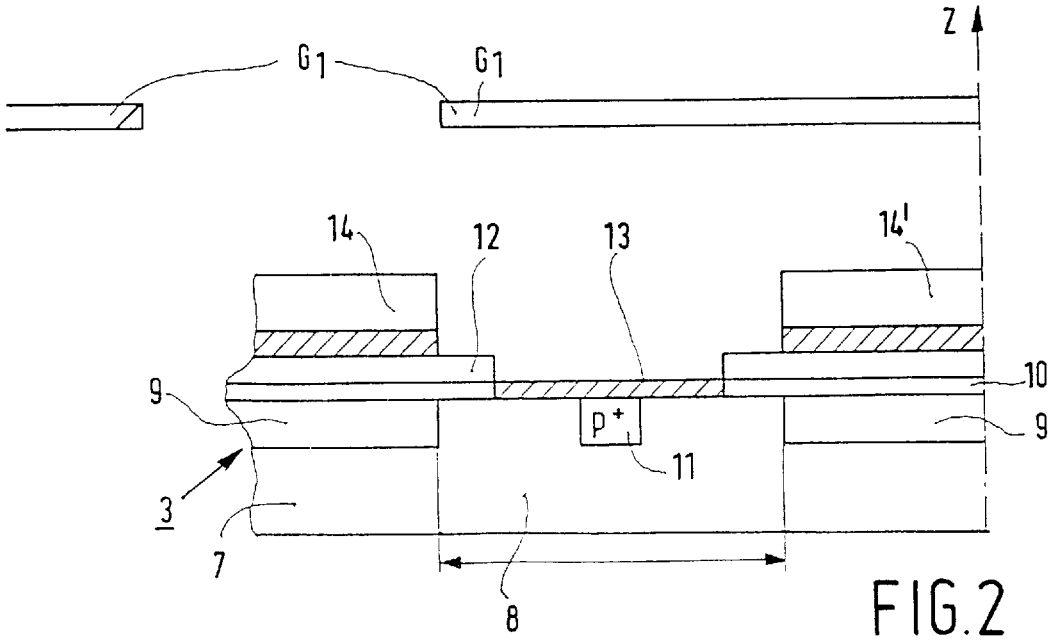
FIG. 2 is a cross-section through a semiconductor cathode.

FIG. 2 is a diagrammatic cross-section through a part of a semiconductor cathode 3, for example, an avalanche cold cathode, provided with a planar electron-optical system and a $G_1$ electrode arranged above it. In this embodiment, electrons are generated in accordance with a desired pattern in the semiconductor cathode 3. To this end, the cathode 3 has a semiconductor body 7 with a p-type substrate 8 of silicon in which an n-type region 9, 10 is provided, which consists of a deep diffusion zone 9 and a thin n-type layer 10 at the area of the actual emission region. To decrease the breakdown of the pn junction between the p-type substrate 8 and the n-type region 9, 10, the acceptor concentration is locally increased in the substrate by means of a p-type region 11 provided by ion implantation. Electron emission is therefore realized within the zone 13 left free by an insulating layer 12, where the electron-emitting surface may also be provided with a mono-atomic layer of a material decreasing the work function, such as cesium. An electrode system 14, 14' ("planar optical system") is arranged on the insulating layer 12 of, for example, silicon oxide, so as to deflect the emitted electrons from the longitudinal axis; this electrode system is also used to shield the subjacent semiconductor body from direct incidence of positive ions.

The emitting region and the electron grids may be considered to be rotated about the axis Z. An annular emitting region, in combination with annular electron grids, produces a hollow electron beam. This beam may be focused by means of focusing lens $G_{3b}$, $G_4$ and deflected across an electron target such as, for example, a phosphor screen.

According to the invention, the electron-optical device is provided with two emitting sub-regions 13, 13' (FIG. 3), so that it generates (symetrically arranged) sub-beams at both sides of the longitudinal axis, which sub-beams first diverge and then converge. As it were, an incomplete, hollow electron beam is then produced. The advantage of a hollow beam is a sharper spot on the electron target due to a reduced repellency of spatial charge in the prefocusing lens area and a reduced contribution of the spherical aberration of the focusing lens.

Figure 3:
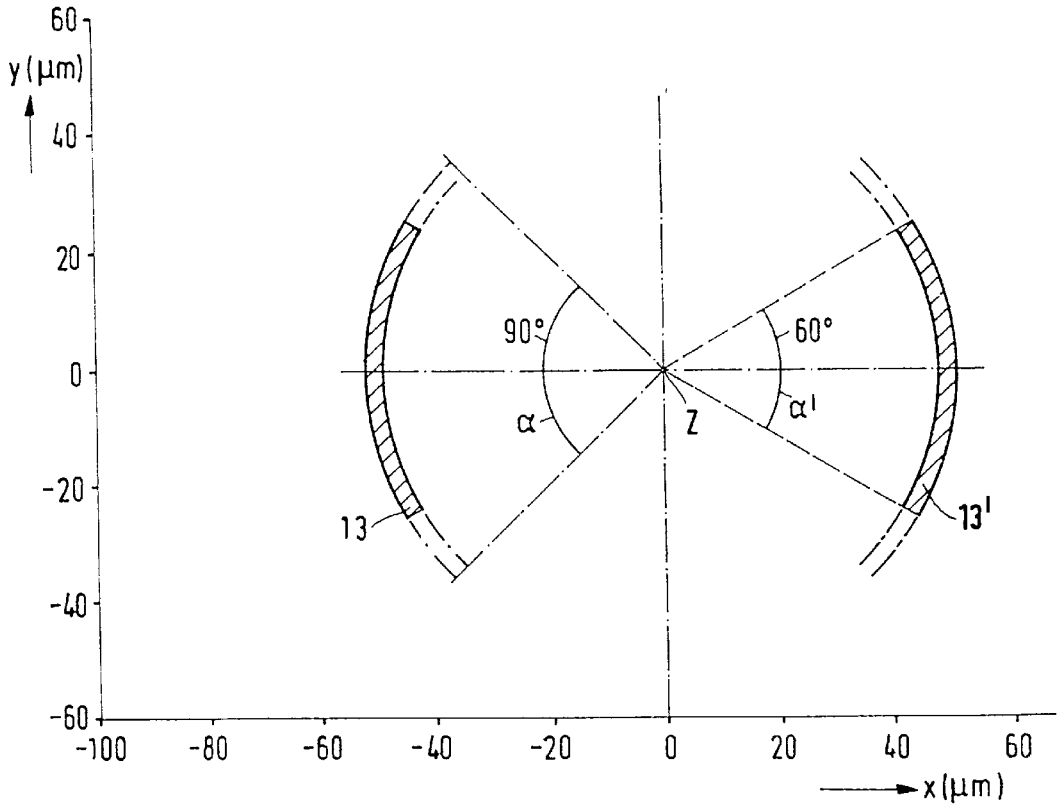
FIG. 3 shows diagrammatically an emitting region constituted by two annular segments.
Figure 4:
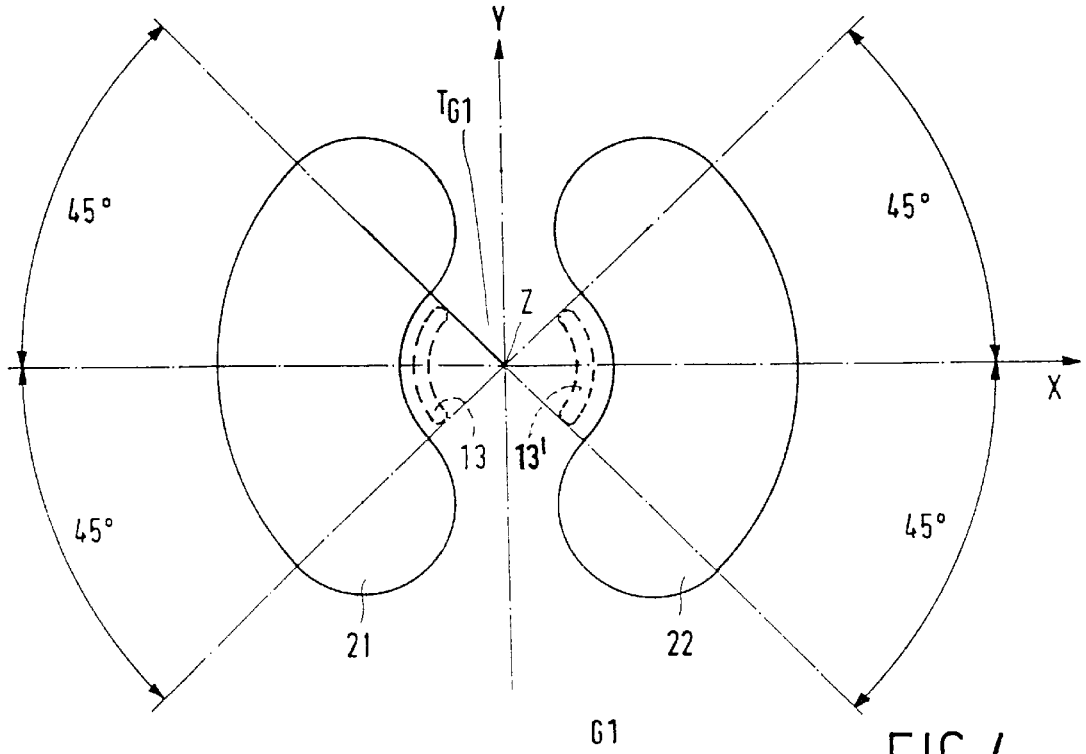
FIG. 4 shows the construction of FIG. 3 in combination with a grid having two apertures.

An embodiment showing the principle of FIG. 3 is the construction shown in FIG. 4, in which two circular segment-shaped surface regions of a cold cathode 13, 13' are used for forming two sub-beams. These beams are first deflected from the longitudinal axis in a manner described hereinbefore (by means of the planar optical system) and subsequently pass the more outwardly located ("off-set") apertures 21 and 22 in the grid $G_1$ situated above the cathode surface with emitting regions 13, 13'. the part $T_{G1}$ of $G_1$ between the apertures 21 and 22, situated above the emitting regions 13, 13', shields the regions 13, 13' from direct incidence of positive ions. The aperture angle of a circular segment may have a value of between 1° and 160°. In this embodiment, elongate segments 13 and 13' have an aperture angle $\alpha$ of 90°. The smallest cross-sections of the segments 13 and 13' are shown to be substantially to an x-axis, which represents an axis of the phosphor screen. The x-axis usually (but not exclusively) is parallel to the longer dimension of the phosphor screen, the y-axis being parallel to the shorter axis.

The invention is applicable to all types of electron emitters, thus not only in (avalanche) cold cathodes, in which a pn junction is driven in the reverse direction, but also to other p-n type emitters in general (including NEA cathodes), field emitters, surface conduction type emitters, and scandate cathodes. An important use of this type of cathode is not only in display tubes but also in electron microscopes and other electron beam-analysis apparatus.

The scandate cathode is distinguished from the current (impregnated) thermionic cathodes by its high current density (loading capacity). This high current density provides the possibility of achieving a significant improvement of the spot size in the current CRTs (notably CMT). A significant improvement of the resolution will then be possible.

The current Sc cathodes are, however, not applicable in standard CRTs, due to their sensitivity to ion bombardment. It is currently being attempted to reduce this sensitivity by means of various methods.

A possible alternative is the reduction of the ion bombardment itself. In fact, the Sc cathode technology has already proved itself, in which a long lifetime at a high current density in the absence of ion bombardment has been found to be possible.

Ion bombardment can be prevented by the combination of the (thermionic) Sc cathode and a grid arrangement (triode) with an ion trap. This arrangement then has a $G_1$ grid with two apertures above the cathode surface situated outside the electron-optical gun axis. Consequently, ions produced above the $G_1$ grid cannot reach the greater part of the cathode surface.

Figure 5:
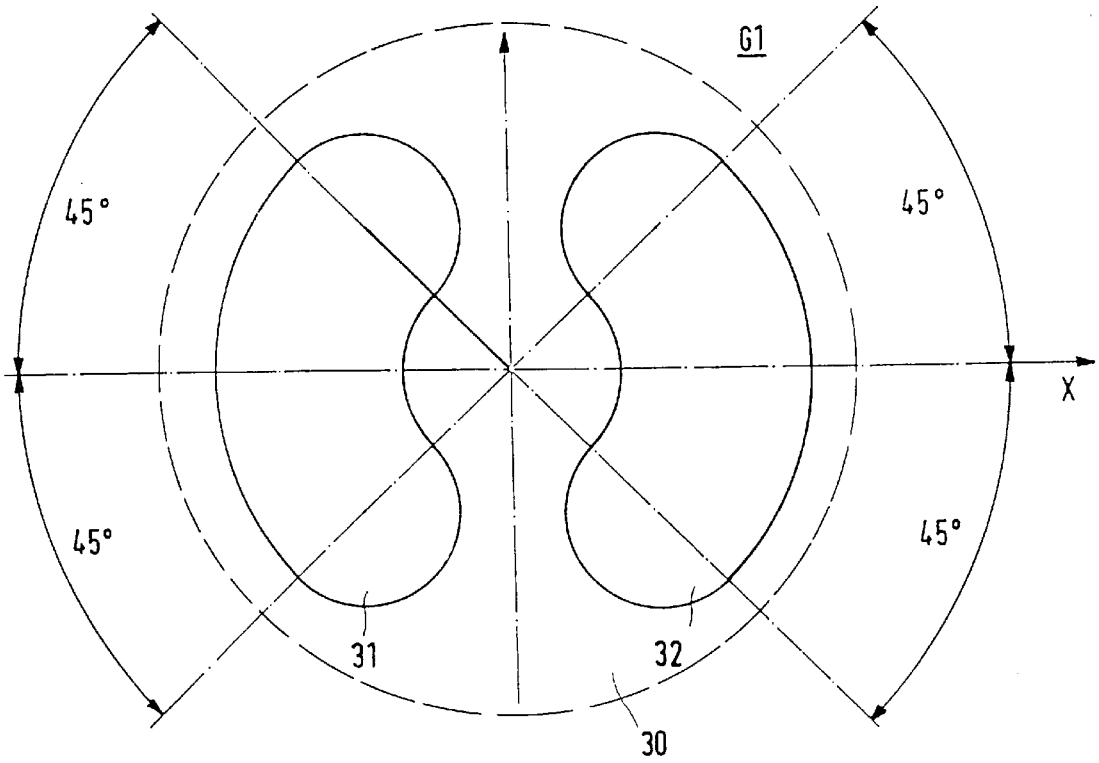
FIG. 5 is a diagrammatic plan view of a $G_1$ electron grid having two apertures, with a circular thermionic cathode surface below it.
Figure 6:
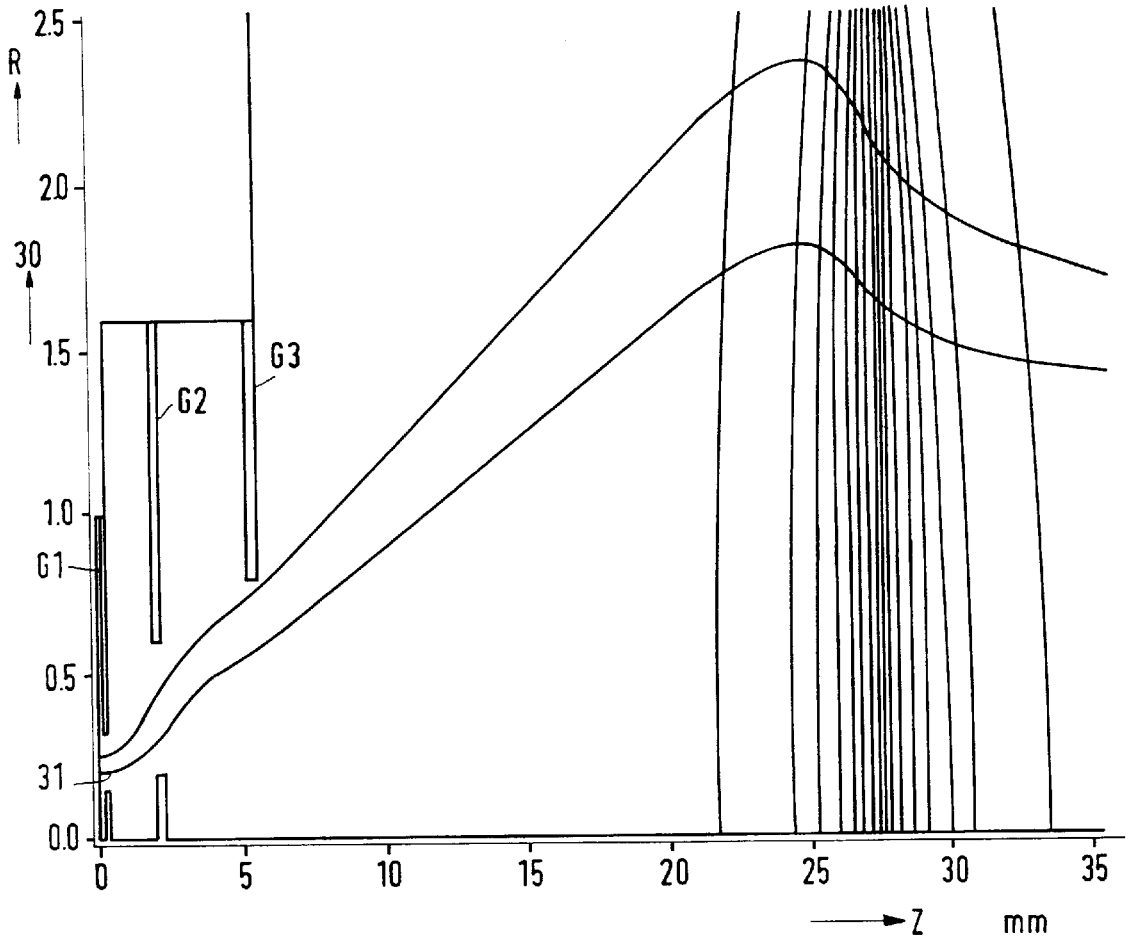
FIG. 6 shows diagrammatically a sub-beam produced by the device of FIG. 5, and FIG. 7 graphically represents the intensity in an y-spot for two kidney-shaped apertures in $G_1$ and for a circular grid aperture, respectively.

Such a construction is shown, for example, in FIG. 5. This Figure shows a circular thermionic-cathode surface 30 with a $G_1$ (and possibly $G_2$) grid with two kidney-shaped apertures 31 and 31 arranged above this surface. These apertures define the ultimate emitting region. The two sub-beams may be focused with the $G_1$ (and the $G_2$). The beam shape per sub-beam in the gun corresponds to that shown in FIG. 6. The apertures 31 and 32 in $G_1$ define the regions which will emit. A real cross-over can be made in the beams by means of a $G_2$. The beam current is modulated by modulating the voltage at $G_1$.

Potential (resolution) advantages (in addition to a long lifetime of the cathode) are:

- smaller spot sizes due to the high cathode brightness (CMT!)
- a smaller spherical aberration contribution of the main lens, due to the hollow beam.
- a smaller repellency of spatial charge in the prefocusing by using a virtual cross-over (in the case of the construction of FIGS. 1, 2, 3).

Figure 7:
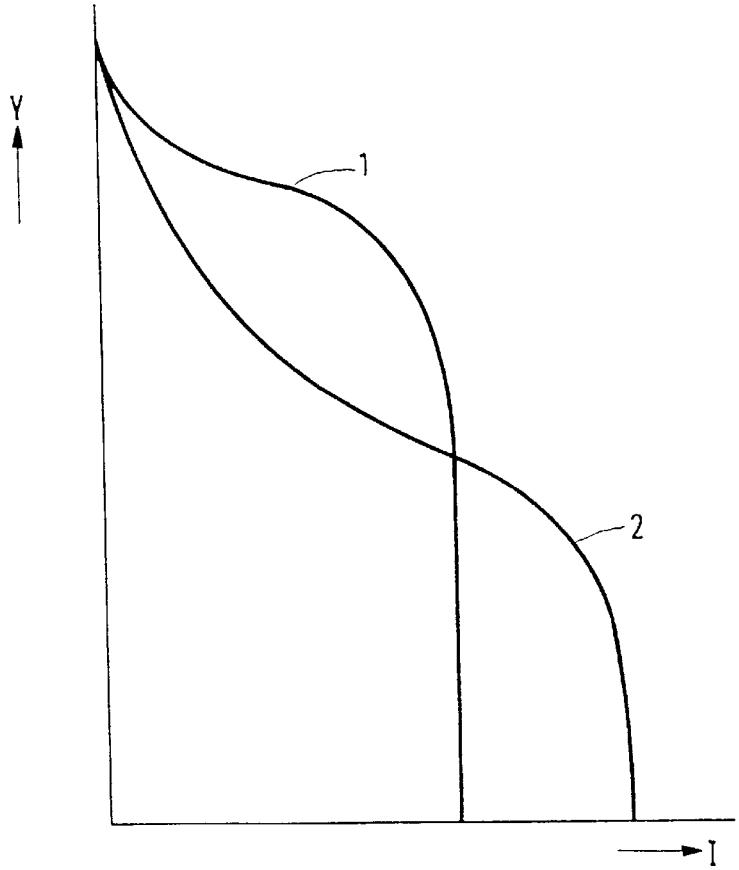

FIG. 7 shows the intensity distribution in the y-spot for the two kidney-shaped grid apertures of FIG. 5 (curve 1), compared with a circular grid aperture (curve 2). Overfocusing upon deflection yields a more homogeneous intensity distribution in the y-direction. The spot size in the y-direction may thus be adjusted ("without" haze). A dynamic focusing signal on the $G_{3a}$ and $G_{3b}$ grids (as shown in FIG. 1) is particularly used in this case.

In summary, the invention thus relates to an electron-optical device having two elongate emitting regions arranged symmetrically with respect to a longitudinal axis for producing two electron beams having an elongate cross-section. By means of electron grids, the two beams are focused at the same point of an electron target arranged transversely to the longitudinal axis and having a short central and a long central axis. The regions have their smallest cross-section parallel to a central axis of the target and preferably parallel to the scanning direction. In other words, when viewing the elongate emitting regions, their smallest dimension is parallel to the scanning direction. Generally, the scanning direction is parallel to the x-axis. By using the invention, the spot size in the x-direction can be controlled satisfactorily. In the other direction (y-direction), the spot size can be satisfactorily controlled by means of dynamic focusing.

We claim:

1. An electron-optical device having a longitudinal axis, an electron-emitting region for producing an electron beam located in a first plane transverse to the axis, and an electron target located opposite thereto in a second plane transverse to the axis, said target having first and second orthogonal axes, the device comprising further a plurality of electron grids arranged between the first and second plane along the longitudinal axis, each grid having at least one aperture for passing electrons, characterized in that the electron-emitting region comprises two separate elongate sub-regions extending on either side of the longitudinal axis for producing respective sub-beams and having a smallest transverse dimension which is oriented substantially parallel to one of the axes of the target.

2. A device as claimed in claim 1, characterized in that the two sub-regions are defined by annular segments.

3. A device as claimed in claim 1, characterized in that the two sub-regions are defined by linear segments.

4. A device as claimed in claim 1, characterized in that the two sub-regions are defined by apertures provided in a grid, below which grid a thermionic-cathode surface is situated.

5. A device as claimed in claim 2, characterized in that the annular segments have an aperture angle of between 1° and 160°.

6. A device as claimed in claim 1, characterized in that the smallest transverse dimension of the emitting sub-regions is parallel to the scanning direction of a target scanning device cooperating with the electron-optical device.

7. An electron-optical device as claimed in claim 4, characterized in that the apertures of a second grid located further remote from the electron-emitting region are located further outwards with respect to the longitudinal axis than the apertures in the first grid.

8. An electron-optical device as claimed in claim 1, characterized in that the electron emitting subregions in operation produce sub-electron beams which each have an elongate cross section.

9. A display tube comprising the electron optical device as claimed in claim 1.

* * * * *